US009528324B2

(12) United States Patent
Fuller et al.

(10) Patent No.: US 9,528,324 B2
(45) Date of Patent: Dec. 27, 2016

(54) UNDERREAMER FOR INCREASING A WELLBORE DIAMETER

(71) Applicant: SMITH INTERNATIONAL, INC., Houston, TX (US)

(72) Inventors: Nathan Fuller, Spring, TX (US); Craig Boswell, Draper, UT (US)

(73) Assignee: Smith International, Inc., Houston, TX (US)

( * ) Notice: Subject to any disclaimer, the term of this patent is extended or adjusted under 35 U.S.C. 154(b) by 233 days.

(21) Appl. No.: 14/208,512

(22) Filed: Mar. 13, 2014

(65) Prior Publication Data

US 2014/0262508 A1 Sep. 18, 2014

Related U.S. Application Data

(60) Provisional application No. 61/788,234, filed on Mar. 15, 2013.

(51) Int. Cl.

| | |
|---|---|
| ***E21B 10/32*** | (2006.01) |
| ***E21B 44/00*** | (2006.01) |
| ***E21B 7/28*** | (2006.01) |
| ***E21B 44/06*** | (2006.01) |

(52) U.S. Cl.

CPC ..... *E21B 10/322* (2013.01); *E21B 7/28* (2013.01); *E21B 44/00* (2013.01); *E21B 44/06* (2013.01)

(58) Field of Classification Search

USPC ..... 175/57

See application file for complete search history.

(56) References Cited

U.S. PATENT DOCUMENTS

| | | | | |
|---|---|---|---|---|
| 2003/0079913 | A1 | 5/2003 | Eppink et al. | |
| 2004/0134687 | A1 * | 7/2004 | Radford et al. | 175/57 |
| 2004/0222022 | A1 | 11/2004 | Nevlud et al. | |
| 2008/0128169 | A1 | 6/2008 | Radford et al. | |
| 2009/0114448 | A1 | 5/2009 | Laird et al. | |
| 2011/0127044 | A1 | 6/2011 | Radford et al. | |
| 2012/0080231 | A1 * | 4/2012 | Radford et al. | 175/57 |

FOREIGN PATENT DOCUMENTS

WO WO 2008150290 A1 * 12/2008

OTHER PUBLICATIONS

Office Action issued in related EP application 14768849.3 on Mar. 9, 2016, 6 pages.

(Continued)

*Primary Examiner* — David Andrews
*Assistant Examiner* — Ronald Runyan

(57) ABSTRACT

An underreamer for increasing a diameter of a wellbore. The underreamer includes a body having an axial bore extending at least partially therethrough. A mandrel is disposed within the bore of the body and has a port formed radially therethrough. A sleeve is disposed radially-outward from the mandrel. The sleeve blocks fluid flow through the port in the mandrel when the sleeve is in a first position, and the sleeve is axially-offset from the port in the mandrel when the sleeve is in a second position. A flow tube is coupled to the mandrel. The sleeve moves from the first position to the second position when fluid flows through the flow tube and through a channel disposed in the mandrel. A cutter block is movably coupled to the body and is responsive to fluid flow from the axial bore through the port in the mandrel.

16 Claims, 7 Drawing Sheets

(56) References Cited

OTHER PUBLICATIONS

International Search Report and Written Opinion issued in International Patent Application No. PCT/US2014/027527, mailed Jul. 3, 2014, 10 pages.
European Search Report issued in European Patent Application No. 14768849.3, mailed Feb. 12, 2016, 4 pages.

* cited by examiner

UNDERREAMER FOR INCREASING A WELLBORE DIAMETER

CROSS-REFERENCE TO RELATED APPLICATIONS

This application claims the benefit of a related U.S. Provisional patent application having Ser. No. 61/788,234 filed on Mar. 15, 2013, entitled "Underreamer for Increasing a Wellbore Diameter," the disclosure of which is incorporated by reference herein in its entirety.

FIELD OF THE INVENTION

Embodiments described herein generally relate to downhole tools. More particularly, such embodiments relate to underreamers for enlarging the diameter of a wellbore.

BACKGROUND INFORMATION

Wellbores are drilled by a drill bit coupled to the end portion of a drill pipe. The drill bit drills the wellbore to an original "pilot hole" diameter. During or after the drilling of the wellbore to the pilot hole diameter, an underreamer is oftentimes also used to enlarge the diameter of the wellbore. The underreamer is run into the wellbore on the drill pipe in an inactive state. In the inactive state, cutter blocks on the underreamer are folded or retracted inwardly into the body of the underreamer such that the cutter blocks are positioned radially-inward from the surrounding casing or wellbore wall. Once the underreamer reaches the desired depth in the wellbore, the underreamer is actuated to an active state. In the active state, the cutter blocks move radially-outward and into contact with the wellbore wall. The cutter blocks are then used to increase the diameter of the wellbore.

Underreamers are generally spaced axially apart from the drill bit on the drill pipe. For example, the underreamer may be positioned "above" the drill bit by between about 30 m and about 60 m. As such, the underreamer is not able to increase the diameter of this lower portion (30 m-60 m) of the wellbore because the drill bit contacts subterranean formation proximate the base of the wellbore, thereby preventing further downward movement of the underreamer. This portion of the wellbore that remains at the pilot hole diameter is oftentimes referred to as the "rat hole." What is needed is an improved system and method for increasing the diameter of the rat hole.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An underreamer for increasing a diameter of a wellbore is disclosed. The underreamer may include a body having an axial bore extending at least partially therethrough. A mandrel may be disposed within the bore of the body and have a port formed radially therethrough. A sleeve may be disposed radially-outward from the mandrel and move axially with respect to the mandrel from a first position to a second position. The sleeve may block fluid flow through the port in the mandrel when in the first position, and the sleeve may be axially-offset from the port in the mandrel when in the second position. A flow tube may be coupled to the mandrel.

The sleeve may move from the first position to the second position when fluid flows through the flow tube. A cutter block may be movably coupled to the body. An outer surface of cutter block may be aligned with, or positioned radially-inward from, an outer surface of the body when the sleeve is in the first position, and the outer surface of the cutter block may be moved or positioned radially-outward from the outer surface of the body when the sleeve is in the second position. The outer surface of the cutter block may be moved or positioned radially-outward from the outer surface of the body in response to the fluid flow through the port.

In another embodiment, the underreamer includes a body having an axial bore extending at least partially therethrough. A control unit may be disposed within the bore of the body. The control unit may include a sensor, a valve seat, and a plunger. The sensor may receive a signal transmitted through the wellbore. The plunger may move axially with respect to the valve seat in response to the signal received by the sensor. The plunger may block fluid flow through the valve seat when in a first position, and the plunger may be axially-offset from the valve seat when in the second position. A flow tube may be coupled to the valve seat and have fluid flow therethrough when the plunger is in the second position. A mandrel may be coupled to the flow tube. The mandrel may have a first port formed radially therethrough in fluid communication with the flow tube. The mandrel may also have a second port formed radially therethrough. A sleeve may be disposed radially-outward from the mandrel and move axially with respect to the mandrel from a first position to a second position when the fluid flows through the flow tube and the first port. The sleeve may block fluid flow through the second port in the mandrel when in the first position, and the sleeve may be axially-offset from the second port in the mandrel when in the second position. A cutter block may be movably coupled to the body. An outer surface of cutter block may be aligned with, or positioned radially-inward from, an outer surface of the body when the sleeve is in the first position, and the outer surface of the cutter block may be positioned radially-outward from the outer surface of the body when the sleeve is in the second position.

A method for increasing a diameter of a wellbore is also disclosed. The method includes running a downhole tool into the wellbore. The downhole tool may include an underreamer having a body and a mandrel disposed within a bore of the body. A signal may be transmitted through the wellbore to a sensor disposed within the bore of the body. A plunger disposed within the bore of the body may move from a first position to a second position in response to the signal received by the sensor. The plunger may block fluid flow through a valve seat when in the first position, and the plunger may be axially-offset from the valve seat when in the second position. Fluid may flow through the valve seat, through a flow tube fluidly coupled to the valve seat, and through a channel disposed in the mandrel fluidly coupled to the flow tube when the plunger is in the second position. A sleeve disposed radially-outward from the mandrel may move from a first position to a second position in response to the fluid flowing into the mandrel from the flow tube. The sleeve may block a port formed radially through the mandrel when in the first position, and the sleeve may be axially-offset from the port in the mandrel when in the second position. A cutter block coupled to the body may move radially-outward in response to the sleeve moving from the first position to the second position.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Figure 1:
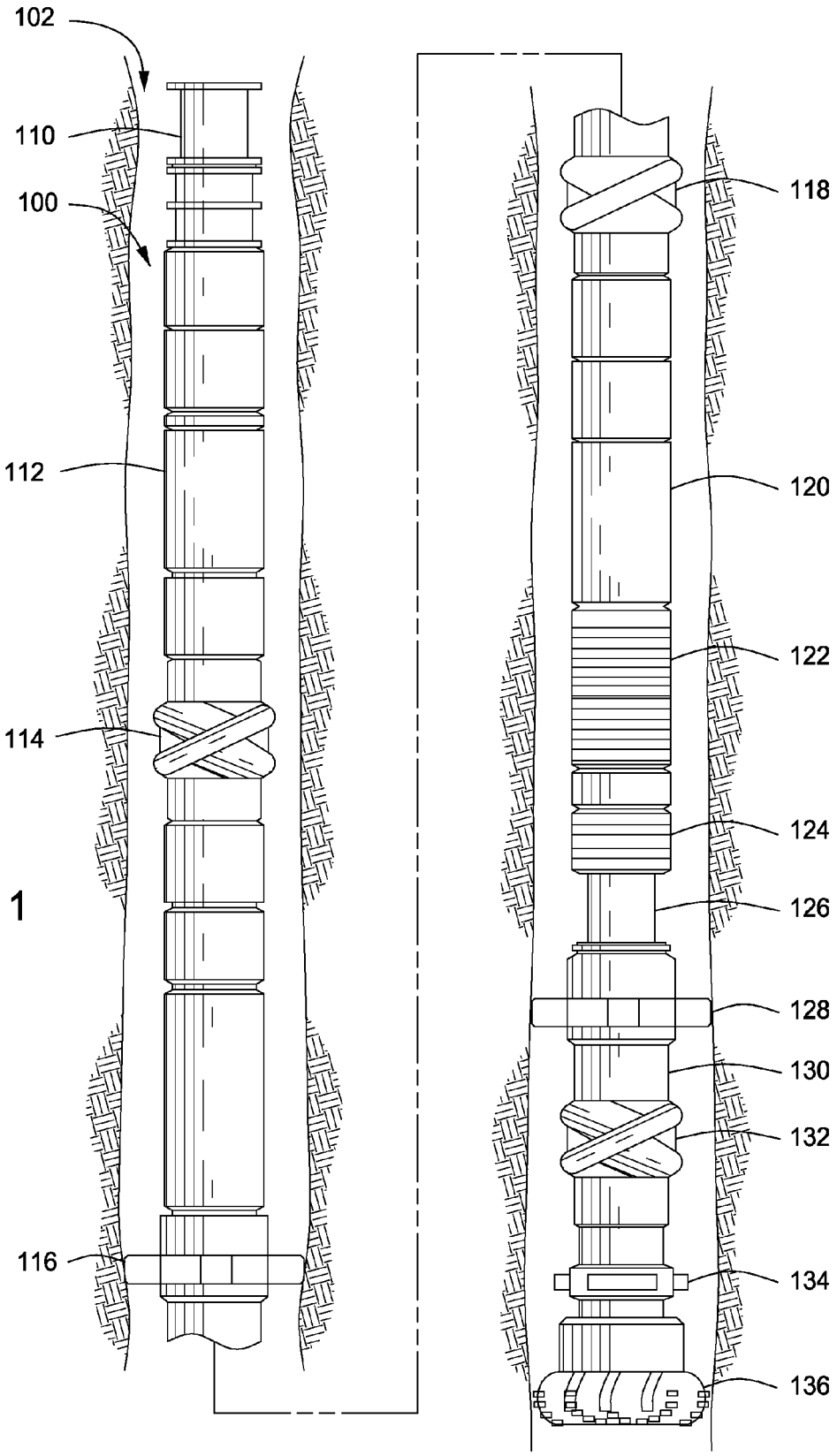
FIG. 1 depicts an illustrative downhole tool disposed within a wellbore, according to one or more embodiments disclosed.

FIG. 1 depicts an illustrative downhole tool 100 disposed within a wellbore 102, according to one or more embodiments. The downhole tool 100 may be run into the wellbore 102 using drill pipe 110. The downhole tool 100 may include a drill collar 112, one or more stabilizers (three are shown: 114, 118, 132), a first underreamer 116, a measuring-while-drilling ("MWD") tool 120, a logging-while-drilling ("LWD") tool 122, a communication device 124, a flexible joint 126, a second underreamer 128, a rotary steerable system (RSS), and a drill bit 136. In at least one embodiment, the rotary steerable system may include a control unit 130 and a bias unit 134.

The measuring-while-drilling tool 120 may include navigation sensors and communicate to the surface (e.g., via mud pulse telemetry). The measuring-while-drilling tool 120 may also include one or more sensors configured to measure loads acting on the drill pipe 110, such as weight on the drill bit 136 ("WOB"), torque on the drill bit 136 ("TOB"), and/or bending moments. The measuring-while-drilling tool 120 may also measure axial, lateral, and/or torsional vibrations in the drill pipe 110 as well as the azimuth and inclination of the drill bit 136, and the temperature and pressure of the fluids in the wellbore 102. The logging-while-drilling tool 122 may include one or more sensors configured to measure properties of the formation and its contents such as formation porosity, density, lithology, dielectric constants, formation layer interfaces, and the pressure and permeability of the fluid in the formation.

The second underreamer 128 may be positioned along the downhole tool 100 between the measuring-while-drilling tool 120 and the drill bit 136, between the logging-while-drilling tool 122 and the drill bit 136, between the communication device 124 and the drill bit 136, between the flexible joint 126 and the drill bit 136, between the control unit 130 and the drill bit 136 (not shown), or between the bias unit 134 and the drill bit 136 (not shown). In at least one embodiment, a distance between the second underreamer 128 and the drill bit 136 may be less than about 50 m, less than about 40 m, less than about 30 m, less then about 20 m, less than about 15 m, less than about 10 m, less than about 7.5 m, less than about 5 m, or less than about 2.5 m.

Figure 2:
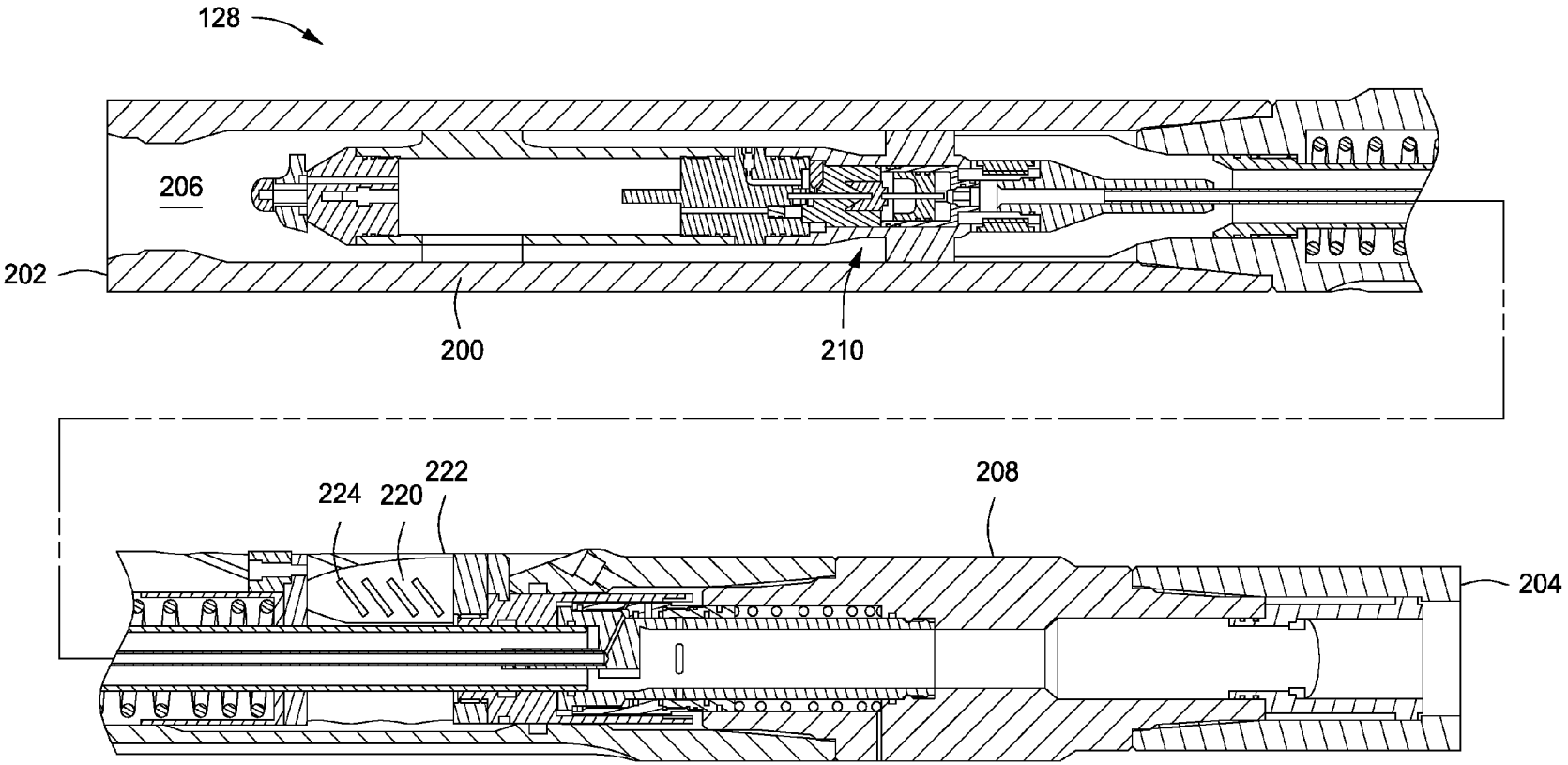
FIG. 2 depicts a partial cross-sectional view of an illustrative underreamer, according to one or more embodiments disclosed.

FIG. 2 depicts a partial cross-sectional view of the second underreamer 128, according to one or more embodiments. The second underreamer 128 includes a substantially cylindrical body 200 having an axial bore 206 extending at least partially (e.g., completely) therethrough. The body 200 may be a single component, or the body 200 may be two or more components coupled together. The body 200 has a first or "upper" end portion 202 and a second or "lower" end portion 204.

One or more cutter blocks 220 are movably coupled to the body 200. Although a single cutter block 220 is shown, the number of cutter blocks 220 may range from a low of about 1, 2, 3, or 4 to a high of about 5, 6, 7, 8, or more. For example, the body 200 may have three cutter blocks 220 movably coupled thereto.

The second underreamer 128 is configured to actuate from an inactive state (as shown in FIG. 2) to an active state. When the second underreamer 128 is in the inactive state, the outer (radial) surfaces 222 of the cutter blocks 220 are aligned with, or positioned radially-inward from, the outer (radial) surface 208 of the body 200. The external surface of the body 200 may have an overall shape of an undergage stabilizer, and the cutter blocks 220 may be contained in the blade of the undergage stabilizer. When in the inactive state, the outer radial surface 222 of the cutter blocks 220 may be retracted inside of the surface of the stabilizer blade. Such design/shape of the second underreamer 128, similar to the design/shape of an undergage stabilizer, may permit sufficient annular flow passage along the second underreamer 128. In another embodiment, when the second underreamer 128 is in the inactive state, the outer (radial) surfaces 222 of the cutter blocks 220 may be positioned radially-outward from the outer (radial) surface 208 of the body 200. In this embodiment, a ratio of the diameter of the outer (radial) surfaces 222 of the cutter blocks 220 to the outer (radial) surface 208 of the body 200 may be between about 1.01:1 and about 1.03:1, between about 1.02:1 and about 1.05:1, between about 1.05:1 and about 1.1:1, between about 1.1:1 and about 1.15:1, between about 1.01:1 and about 1.15:1, or more. When the cutter blocks 220 are positioned radially-outward from the body 200 in the inactive state, the cutter blocks 220 may stabilize the body 200 in the wellbore 102.

The cutter blocks 220 have a plurality of splines (also known as a "Z-drive") 224 formed on the outer (side) surfaces thereof. The splines 224 may be or include offset ridges or protrusions configured to engage corresponding grooves or channels in the body 200. The splines 224 on the cutter blocks 220 (and the corresponding grooves) are oriented at an angle with respect to a longitudinal axis through the body 200. The angle may range from a low of about 10°, about 15°, or about 20° to a high of about 25°, about 30°, about 35°, or more. For example, the angle may be between about 15° and about 25°, or about 17° and about 23°. Although four splines 224 are shown, it will be appreciated that the number of splines 224 may range from a low of about 1, 2, 3, 4, or 5 to a high of about 10, about 15, about 20, about 25, about 30, or more.

When the second underreamer 128 transitions from the inactive state to the active state, the engagement of the splines 224 on the cutter blocks 220 and the grooves in the body 200 cause the cutter blocks 220 to simultaneously move axially toward the first end portion 202 of the body 200 and radially-outward with respect to the body 200. The resultant movement may be at an angle between about 15° and about 25°, or about 17° and about 23° with respect to the longitudinal axis through the body 200. This movement of the cutter blocks 220 transitions the second underreamer 128 into the active state.

Figure 8:
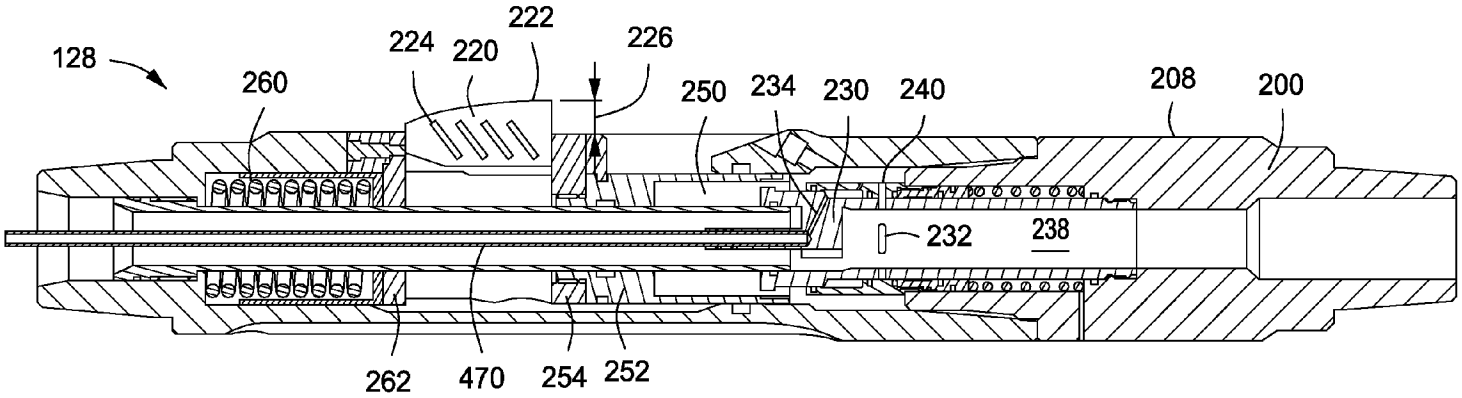
FIGS. 8 and 9 depict partial cross-sectional views of the second underreamer in an active state, according to one or more embodiments disclosed.

When the second underreamer 128 is in the active state, the outer (radial) surfaces 222 of the cutter blocks 220 are positioned radially-outward from the outer (radial) surface 208 of the body 200 by a distance 226 (see FIG. 8). A ratio of the diameter of the outer (radial) surfaces 222 of the cutter blocks 220 to the outer (radial) surface 208 of the body 200 may be between about 1.1:1 and about 1.2:1, between about 1.15:1 and about 1.25:1, between about 1.2:1 and about 1.3:1, between about 1.25:1 and about 1.35:1, between about 1.3:1 and about 1.4:1 or more. In addition, a ratio of the distance 226 (see FIG. 8) to the diameter of the body 200 may range from a low of about 1:4, about 1:5, about 1:6, or about 1.7 to a high of about 1:8, about 1:9, about 1:10, about 1:12, or more.

The cutter blocks 220 each have a plurality of cutting contacts or elements disposed on the outer (radial) surface 222 thereof. In at least one embodiment, the cutting contacts of the cutter blocks 220 may be or include polycrystalline diamond compact ("PDC") or the like. The cutting contacts on the cutter blocks 220 are configured to cut, grind, shear, and/or crush the wall of the wellbore 102 to increase the diameter thereof when the second underreamer 128 is in the active state. The cutter blocks 220 may also include a plurality of stabilizer pads (not shown) disposed on the outer (radial) surface 222 thereof. When the cutter blocks 220 include cutting contacts and stabilizer pads, the cutter blocks 220 may function as a cleanout stabilizer. When the cutter blocks 220 include stabilizer pads but no cutting contacts, the cutter blocks 220 may function as an expandable stabilizer.

In at least one embodiment, a first cutter block 220 of the second underreamer 128 may have a different height (as measured radially outward from the body 200) than a second cutter block (not shown). For example, the first cutter block 220 may have a greater height than the second cutter block. In this embodiment, the first cutter block 220 may act as a stabilizer when the second underreamer 128 is in the inactive state, and the first cutter block 220 may push the body 200 off the longitudinal axis of the wellbore 102 when the second underreamer 128 is in the active state to allow bi-centric cutting to occur. A control unit 210, e.g., a remote control unit, is disposed within the bore 206 of the body 200. The control unit 210 is configured to actuate the cutter blocks 220 from the inactive state to the active state and vice versa, as described in greater detail below.

Figure 3:
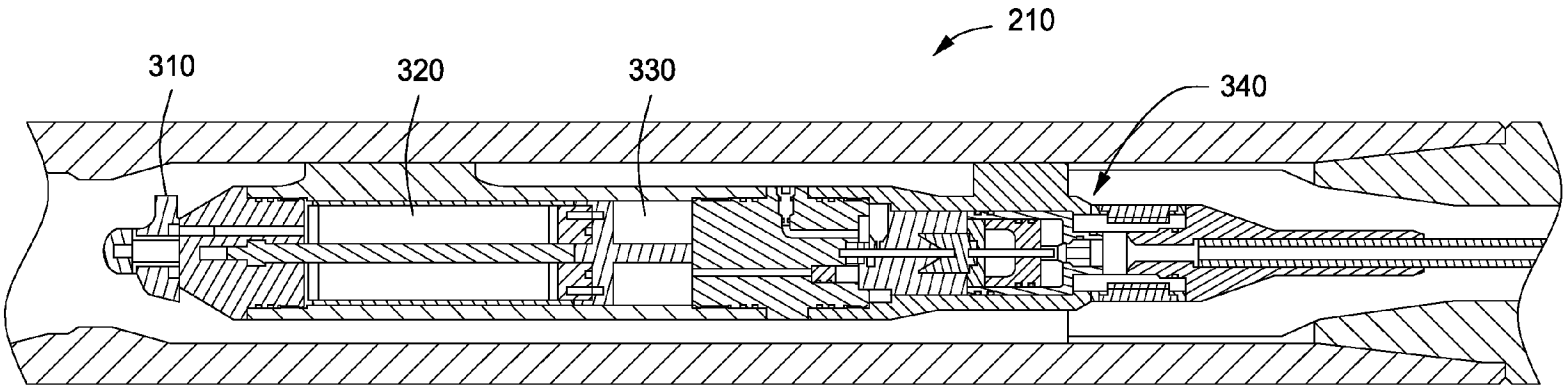
FIG. 3 depicts a partial cross-sectional view of an illustrative control unit in a second underreamer, according to one or more embodiments disclosed.

FIG. 3 depicts a partial cross-sectional view of the control unit 210, according to one or more embodiments. The control unit 210 may include one or more sensors (one is shown: 310), one or more batteries 320 to provide electrical power, an electronics unit 330, and an actuator unit 340. The sensor 310 is configured to receive one or more signals, e.g., hydraulic signals, transmitted through the wellbore 102, e.g., via the drill pipe 110, from the surface that direct the control unit 210 to actuate the second underreamer 128 from the inactive state to the active state, or vice versa. In at least one embodiment, the downhole tool 100 (FIG. 1) may include a plurality of control units, and each control unit may send and/or receive different signals. Each control unit may be used to actuate a different component (e.g., underreamer) of the downhole tool 100.

The sensor 310 may be or include a flow sensor, a pressure sensor, a vibration sensor, or the like, and the signals may be in the form of flow pulses/variations, pressure pulses/variations, or vibration pulses/variations. The electronics unit 330 may interpret the signals received by the sensor 310. In response to the signals, the electronics unit 330 may control the actuator unit 340.

Figure 4:
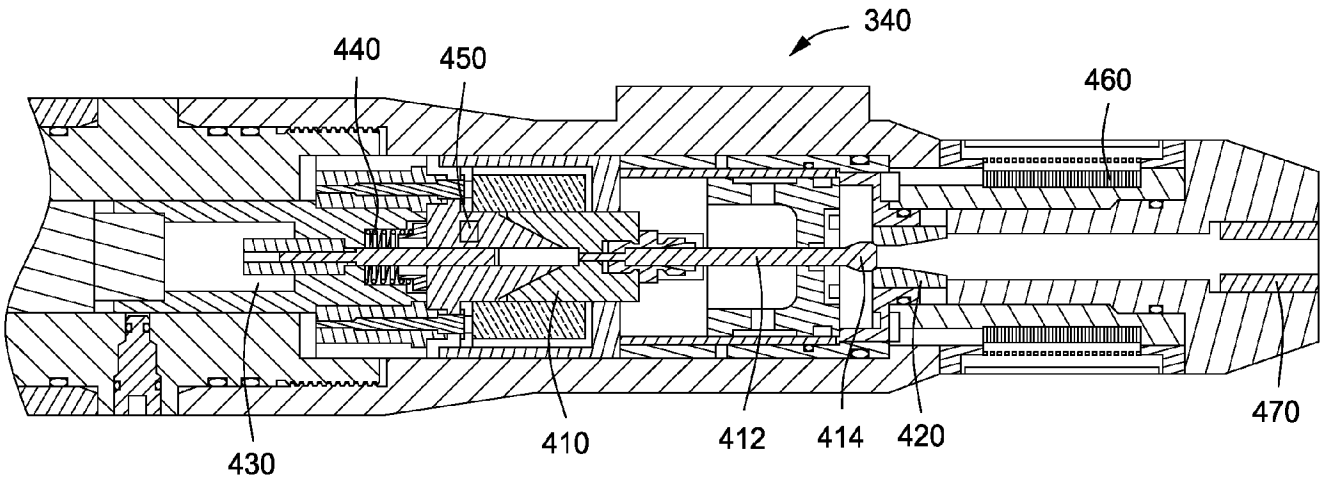
FIG. 4 depicts a partial cross-sectional view of an illustrative actuator unit when the second underreamer is in an inactive state.
Figure 5:
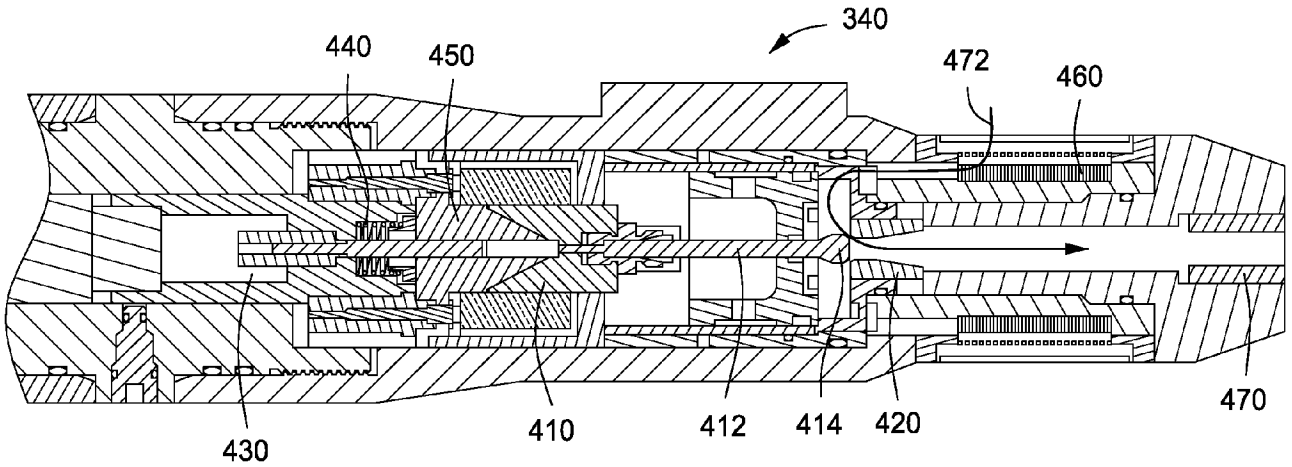
FIG. 5 depicts a partial cross-sectional view of the actuator unit when the second underreamer is in an active state, according to one or more embodiments disclosed.

FIG. 4 depicts a partial cross-sectional view of the actuator unit 340 when the second underreamer 128 is in the inactive state, and FIG. 5 depicts a partial cross-sectional view of the actuator unit 340 when the second underreamer 128 is in the active state, according to one or more embodiments. The actuator unit 340 may include a solenoid 410 having a shaft 412 coupled thereto. A plunger or valve 414, e.g., a poppet valve, on an end portion of the shaft 412 is configured to sealingly engage a valve seat 420 to prevent fluid flow therethrough when the second underreamer 128 is in the inactive state (see FIG. 4). The plunger 414 and/or the valve seat 420 may be made of ceramic transition-toughened zirconia, tungsten carbide, polycrystalline diamond, or the like.

When the control unit 210 determines that the second underreamer 128 is to actuate into the active state, the control unit 210 directs, e.g., by supplying electrical current to, the solenoid 410 and the shaft 412 to move axially with respect to the valve seat 420 to allow fluid flow through the valve seat 420. As shown, the solenoid 410 and the shaft 412 move toward the first end portion 202 of the body 200 (to the left as shown in FIG. 5) a small distance. The distance may be from about 0.5 mm to about 5 mm or about 1 mm to about 2.5 mm. In other embodiments, the distance may be from about 5 mm to about 10 mm, about 10 mm to about 20 mm, about 20 mm to about 40 mm, or more. A position sensor 430 may be used to determine the position of the solenoid 410 and the shaft 412 and, thus, the state of the second underreamer 128. The position sensor 430 may communicate the position back to the electronics unit 330 in the control unit 210. Such position information permits the control unit 210 to lower the current applied to the solenoid 410 after opening the valve 414. The action of valve opening uses a larger pull force (and current applied to solenoid 410) than maintaining the valve in the open position. This selective reduction in current applied to the solenoid 410 lowers the energy consumption from the one or more batteries 320. The heat output from the electronics unit 330 and solenoid 410 are also reduced. Based on feedback from the position sensor 430, the electronics unit 330 may reapply current to the solenoid 410 to open the valve when the actuator unit 340 closes at least partially due to external perturbations, such as shocks, flows or pressure conditions, or other causes, such as spring bias. The status of the position sensor 430 may be conveyed from the control unit 210 to the measuring-while-drilling tool 120 (see FIG. 1) for transmission uphole, e.g., via mud pulse telemetry, such that underreamer setting may be monitored.

The position of the plunger or valve 414 should correspond to the last successfully received signal/command received from uphole. Under high-shock drilling conditions, the plunger or valve 414 may be inadvertently set in an undesired position (e.g., when there is little to no fluid flow through axial bore 106). The electronics unit 330 monitors and/or verifies the position of plunger or valve 414 via the position sensor 430 and compares the sensed position to the desired/expected position. If the electronics unit 330 determines that the plunger or valve 414 is in an undesired position, then the electronics unit 330 initiates a new actuation of the actuator 340.

The actuator 340 may be arranged and designed such that actuation to the open position occurs when there is little to no fluid flow through the axial bore 206. When there is little to no fluid flow through the axial bore 206, there may also be little to no pressure differential between the axial bore 206 and the well annulus. Thus, the valve 414 experiences minimal, if any, self-closing effects due to pressure differential. The actuation of the actuator 340 under minimal self-closing effects is advantageous because smaller currents and smaller components may be used.

When the solenoid 410 and the shaft 412 move toward the first end portion 202 of the body 200, the solenoid 410 compresses a spring 440. In at least one embodiment, a locking unit 450 may secure or "lock" the solenoid 410 and the shaft 412 in place when the second underreamer 128 is in the active state, thereby maintaining the spring 440 in the compressed state. Thus, the actuator 340 may remain in the open position without the application of a current. A short duration current pulse may control the locking unit 450 during in the opening of the actuator 340. In another embodiment, the solenoid 410 may stay energized until a deactivate command is received. Nevertheless, even if a constant or near constant current is used to energize the solenoid to maintain the actuator 340 in an open position, the current to maintain the open position will be less than the current to actuate the plunger or valve 414 to the open position, e.g., from closed or near closed position.

Once the second underreamer 128 is in the active state, fluid may flow radially-inward through a filter 460. The filter 460 is configured to prevent particles (e.g., sand, drilling fluid additives such as LCM, and other contaminants) from flowing therethrough to the control unit 210. More particularly, the filter 460 is configured to prevent particles from passing therethrough that would prevent the plunger or valve 414 from sealing against the valve seat 420 or would plug the channel or port 234 (see FIG. 6). The filter 460 may be constructed of a wrapper trapezoid wire, as used in sand control. The external surface of the filter 460 may be kept clean by ensuring that mud velocity around the filter 460 is sufficient (e.g., above 20 feet/second). Thus, the flow restrictor may be chosen in accordance with the fluid flow rate to keep the flow velocity sufficient for filter self-cleaning. Once through the filter 460, the fluid may then flow toward the first end portion 202 of the body 200, through the valve seat 420 (now unobstructed by the plunger 414), and through a flow tube 470 toward the second end portion 204 of the body 200. The flow path of the fluid is indicated by the arrows 472 in FIG. 5.

When the control unit 210 determines that the second underreamer 128 is to actuate back into the inactive state, the control unit 210 de-energizes the solenoid 410 (or the locking unit 450 releases the solenoid 410), and the compressed spring 440 moves the solenoid 410 and the shaft 412, thereby moving the plunger 414 back into sealing engagement with the valve seat 420 to once again prevent fluid flow through the valve seat 420 and the flow tube 470.

In another embodiment, rather than a shaft 412 and a plunger 414 that move axially with respect to a valve seat 420, a rotary valve (not shown) may be used to block and/or allow fluid to flow therethrough and into the flow tube 470. For example, the rotary valve may include first and second components that each have axial openings formed therethrough that are circumferentially offset from one another. When the control unit 210 determines that the second underreamer 128 is to actuate into the active state, the control unit 210 causes the first component to rotate with respect to the second component such that the openings in the first and second components become aligned, thereby forming a flow path therethrough into the flow tube 470. When the control unit 210 determines that the second underreamer 128 is to actuate back into the inactive state, the control unit 210 causes the first component to rotate with respect to the second component such that the openings in the first and second components are no longer aligned, thereby obstructing the flow of fluid into the flow tube 470.

Figure 6:
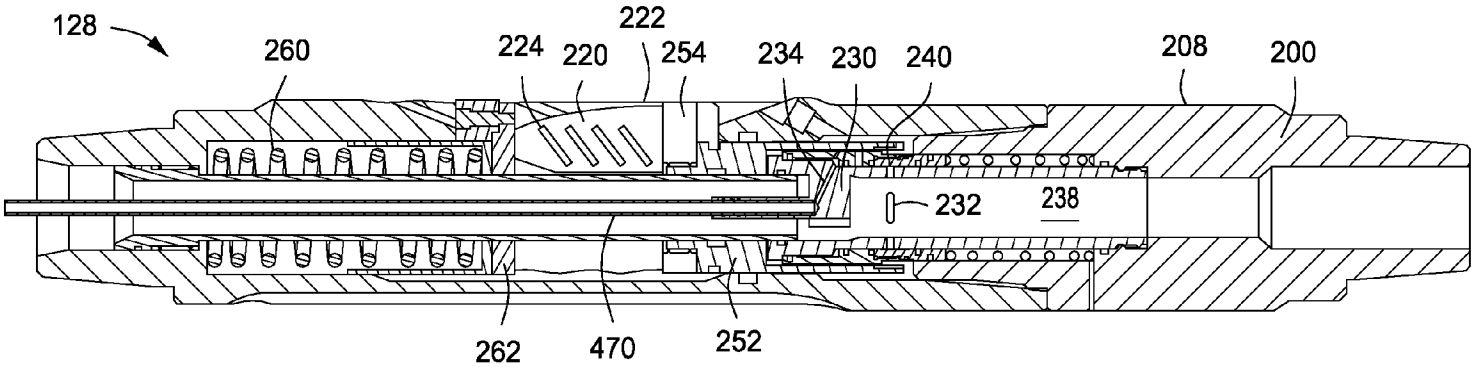
FIGS. 6 and 7 depict partial cross-sectional views of the second underreamer in an inactive state, according to one or more embodiments disclosed.
Figure 7:
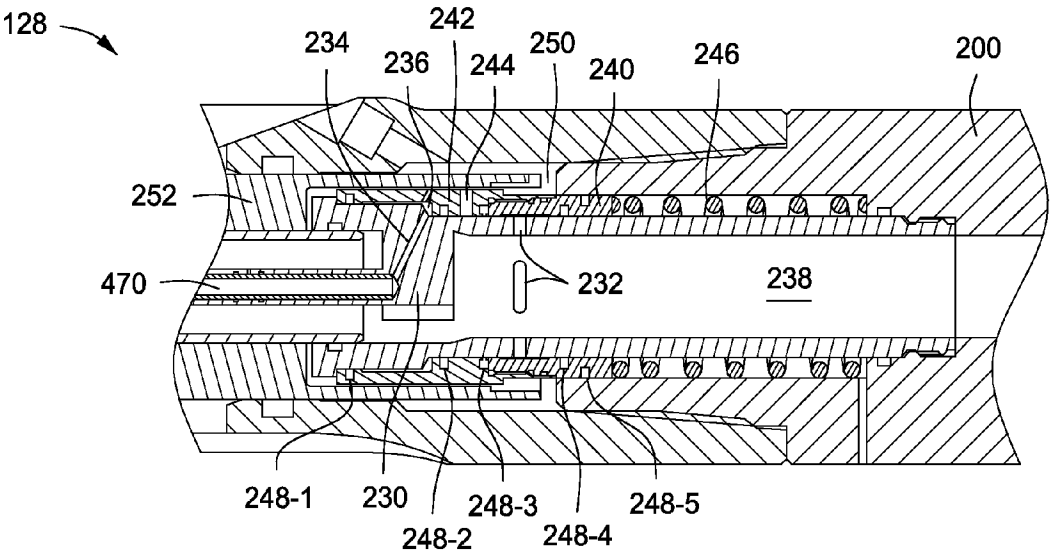

FIGS. 6 and 7 depict partial cross-sectional views of the second underreamer 128 in the inactive state, according to one or more embodiments. The flow tube 470 may be coupled to and in fluid communication with a mandrel 230 disposed within the bore 206 of the body 200. The mandrel 230 may have one or more ports 232 formed radially therethrough. For example, mandrel 230 may include a plurality of ports 232 that are circumferentially-offset from one another. When the second underreamer 128 is in the inactive state, an annular sleeve 240 disposed radially-outward from the mandrel 230 is axially aligned with the ports 232 and prevents fluid flow therethrough. This causes the cutter blocks 220 to be positioned in the inactive state, as shown in FIG. 6.

Figure 9:
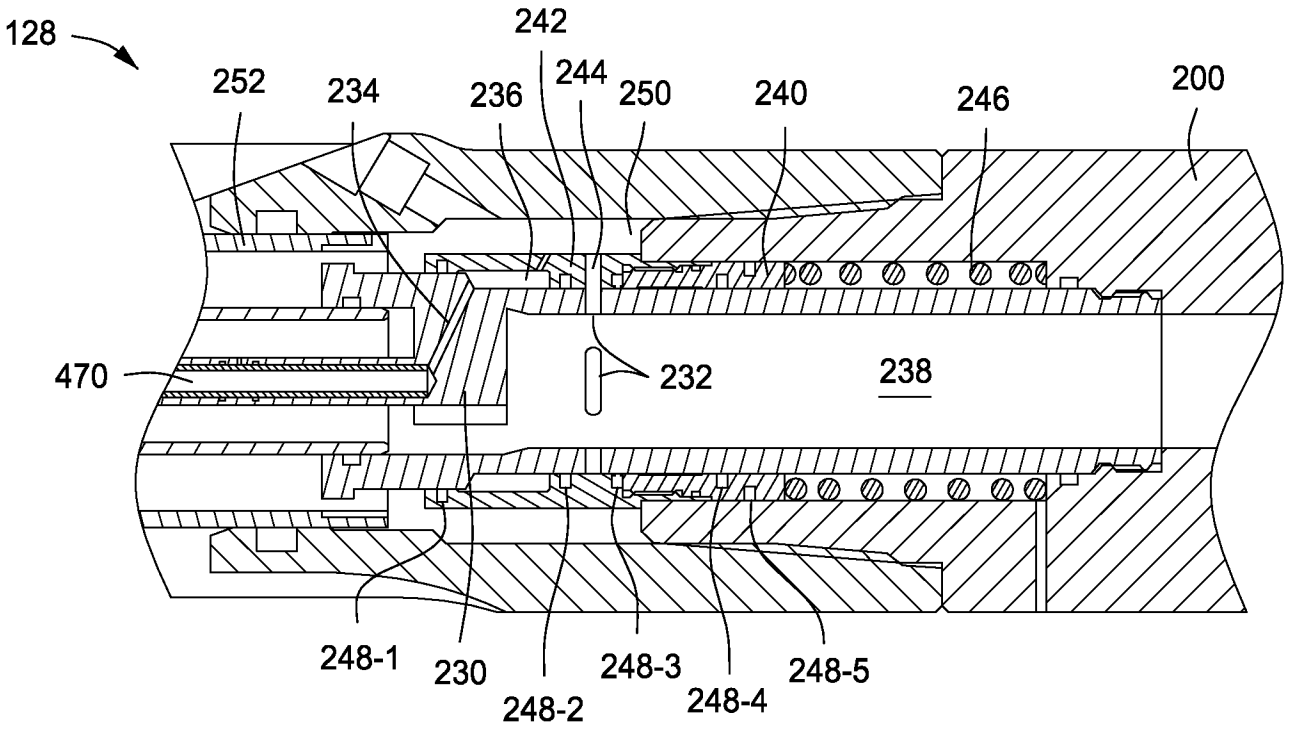

FIGS. 8 and 9 depict partial cross-sectional views of the second underreamer 128 in the active state, according to one or more embodiments. When the second underreamer 128 is actuated into the active state, fluid flows through the valve seat 420 (see FIG. 5) and the flow tube 470 toward the second end portion 204 of the body 200 (to the right as shown in FIGS. 8 and 9). The fluid then flows radially-outward through a channel 234 formed in the mandrel 230 into a first chamber 236. As the fluid flows into the first chamber 236, the pressure in the first chamber 236 increases. This increase in pressure causes a first piston 242 to move axially toward the second end portion 204 of the body 200 (to the right as shown in FIGS. 8 and 9). The movement of the first piston 242 causes the sleeve 240 to also move axially toward the second end portion 204 of the body 200, thereby compressing a spring 246. In at least one embodiment, the first piston 242 and the sleeve 240 may be a single component.

A plurality of seals (five are shown: 248-1, 248-2, 248-3, 248-4, 248-5) may prevent the fluid from leaking between adjacent components. The seals 248-1, 248-2, 248-3, 248-4, 248-5 may be dynamic and configured to move with the first piston 242 and/or the sleeve 240.

When the first piston 242 and the sleeve 240 move toward the second end portion 204 of the body 200, the sleeve 240 uncovers the one or more ports 232 in the mandrel 230, and one or more ports 244 formed radially through the first piston 242 become aligned with the one or more ports 232 in the mandrel 230. When the ports 232, 244 are aligned, fluid may flow from a bore 238 in the mandrel 230 through the ports 232, 244, and into a second chamber 250. As the fluid flows into the second chamber 250, the pressure in the second chamber 250 increases. The pressure in the first chamber 236 and the second chamber 250 may equalize, and the flow in the flow tube 470 may become stagnant. The increase in pressure causes a second piston 252 to move axially toward the first end portion 202 of the body 200 (to the left as shown in FIGS. 8 and 9). The movement of the second piston 252 causes a drive ring 254 to also move axially toward the first end portion 202 of the body 200. The drive ring 254 exerts a force on the cutter blocks 220 in a direction toward the first end portion 202 of the body 200.

When the drive ring 254 exerts the axial force on the cutter blocks 220 in a direction toward the first end portion 202 of the body 200, the engagement of the splines 224 on the cutter blocks 220 and the grooves in the body 200 cause the cutter blocks 220 to simultaneously move axially toward the first end portion 202 of the body 200 and radially outward. The resultant movement may be at an angle between about 15° and about 25°, or about 17° and about 23° with respect to the longitudinal axis through the body 200. This movement of the cutter blocks 220 transitions the second underreamer 128 into the active state. When the second underreamer 128 is in the active state, the cutter blocks 220 are positioned as shown in FIG. 8 such that the outer (radial) surfaces 222 of the cutter blocks 220 are radially-outward from the outer (radial) surface 208 of the body 200.

Figure 10:
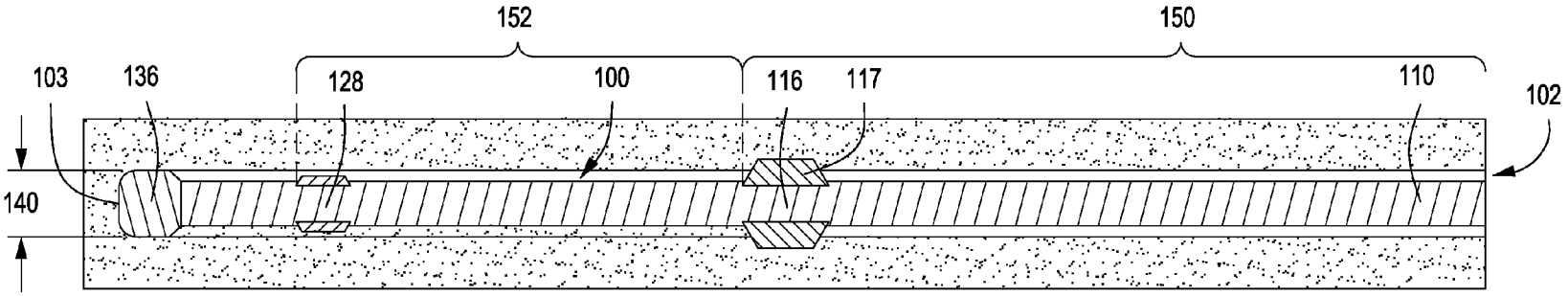
FIGS. 10, 11 and 12 depict the first and second underreamers increasing the diameter of the wellbore, according to one or more embodiments disclosed.
Figure 11:
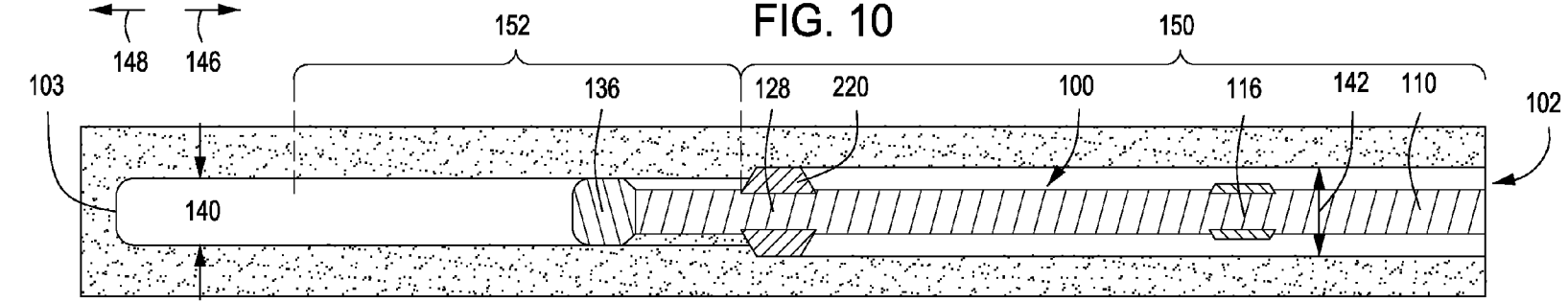
Figure 12:
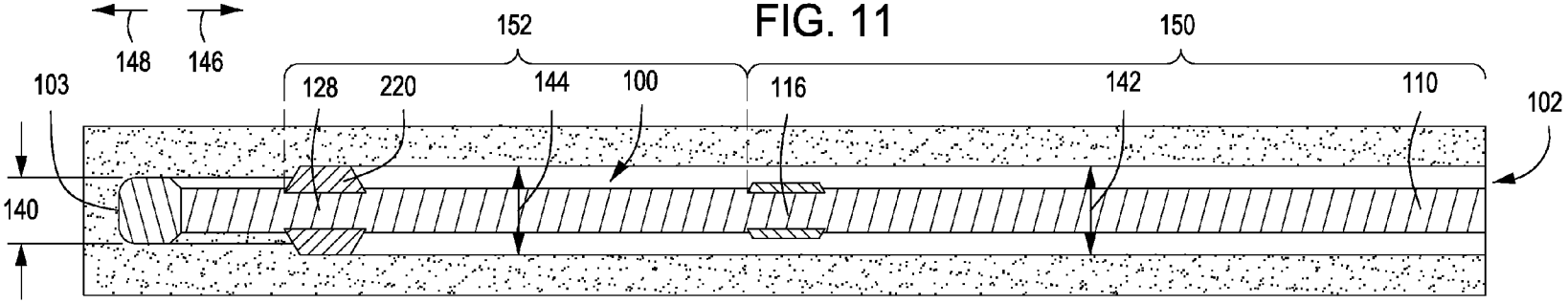

FIGS. 10, 11, and 12 depict the first and second underreamers 116, 128 increasing the diameter of the wellbore 102, according to one or more embodiments. In operation, the drill pipe 110 runs the downhole tool 100 with the first and second underreamers 116, 128 coupled thereto into the wellbore 102. The first and second underreamers 116, 128 may be in the inactive state as the drill bit 136 drills the wellbore 102 to a first "pilot hole" diameter 140. The first diameter 140 may be between about 5 cm and about 15 cm, between about 10 cm and about 20 cm, between about 15 cm and about 25 cm, between about 20 cm and about 30 cm, between about 25 cm and about 35 cm, or more. For example, the first diameter 140 may be between about 16 cm and about 20 cm, between about 18 cm and about 22 cm, between about 20 cm and about 24 cm, between about 22 cm and 26 cm, or between about 24 cm and about 28 cm.

After the drill bit 136 drills the wellbore 102 to the desired depth, the first underreamer 116 may be actuated into the active state, as shown in FIG. 10. When the first underreamer 116 is in the active state, the drill pipe 110 may pull the downhole tool 100 back toward the surface (i.e., upward, as shown by arrow 146). As the first underreamer 116 moves upward, the cutter blocks 117 (now expanded radially-outward) cut or grind the wall of the wellbore 102 to increase the diameter of a first portion 150 of the wellbore 102 from the first diameter 140 to a second diameter 142. The first portion 150 of the wellbore 102 extends upward from the position of the first underreamer 116 when the drill bit 136 is positioned proximate the base 103 of the wellbore 102. The second diameter 142 may be between about 10 cm and about 20 cm, between about 15 cm and about 25 cm, between about 20 cm and about 30 cm, between about 25 cm and about 35 cm, between about 30 cm and about 40 cm, or more.

Although not shown, in another embodiment, after the drill bit 136 drills the wellbore 102 to the desired depth, the drill pipe 110 may pull the downhole tool 100 back toward the surface (i.e., upward, as shown by arrow 146). The first underreamer 116 may then be actuated into the active state, and the drill pipe 110 may then lower the downhole tool 100. As the first underreamer 116 moves downward, the cutter blocks 117 (now expanded radially-outward) cut or grind the wall of the wellbore 102 as described above.

Although not shown, in yet another embodiment, the first underreamer 116 may be in the active state as the drill bit 136 drills the wellbore 102 to the first "pilot hole" diameter 140—i.e., one-pass underreaming (also known as hole enlargement while drilling or "HEWD"). The second underreamer 128 may be in the inactive state during this initial drilling phase.

After the first underreamer 116 has increased the diameter of the first portion 150 of the wellbore 102 (e.g., during or after drilling of the wellbore 102 with drill bit 136), the first underreamer 116 may be actuated into the inactive state, and the second underreamer 128 is actuated into the active state, as shown in FIG. 11. The second underreamer 128 may be positioned within the first portion 150 of the wellbore 102 when actuated into the active state; however, in another embodiment, the second underreamer 128 may also be positioned within a second portion 152 of the wellbore 102 when actuated into the active state. The second portion 152 of the wellbore 102 extends from the position of the first underreamer 116 to the position of the second underreamer 128 when the drill bit 136 is positioned proximate the base 103 of the wellbore 102. The second portion 152 of the wellbore 102 is also known as the "rat hole."

Still referring to FIGS. 10, 11, and 12, with additional reference now to FIGS. 1-9, to actuate the second underreamer 128 into the active state, one or more signals are sent down the wellbore 102 from the surface and received by the sensor 310 in the control unit 210. In at least one embodiment, the fluid flow rate through axial bore 106 is reduced considerably (or even stopped) after receiving the required signals to the control unit 210. Such flow condition may be maintained for a short time period, e.g., for as long as about 15 minutes. The electronics unit 330 interprets the signals and causes the solenoid 410 and the shaft 412 to move away from the valve seat 420, thereby removing the sealing engagement between the plunger 414 and the valve seat 420. Fluid may then flow through the filter 460, the valve seat 420 (now unobstructed), the flow tube 470, and the channel 234. As the fluid enters the first chamber 236, the fluid causes the first piston 242 and the sleeve 240 to move such that the sleeve 240 uncovers the ports 232 in the mandrel 230. The ports 232 in the mandrel 230 become aligned with the ports 244 in the first piston 242 so that fluid flows from the bore 238 in the mandrel 230 through the ports 232, 244 and into the second chamber 250. The fluid flowing into the second chamber 250 causes the second piston 252 to move the drive ring 254. The drive ring 254 moves the cutter blocks 220 axially toward the first end portion 202 of the body 200 and radially-outward, thereby transitioning the second underreamer 128 in the active state.

Once the second underreamer 128 is in the active state, the drill pipe 110 may move the downhole tool 100 away from the surface (e.g., downward, as shown by arrow 148). As the second underreamer 128 moves downward, the cutter blocks 220 (now expanded radially-outward) cut or grind the wall of the wellbore 102 to increase the diameter of the second portion 152 of the wellbore 102 from the first diameter 140 to a third diameter 144, as shown in FIG. 12. The third diameter 144 may be between about 10 cm and about 20 cm, between about 15 cm and about 25 cm, between about 20 cm and about 30 cm, between about 25 cm and about 35 cm, between about 30 cm and about 40 cm, or more. For example, the third diameter 144 may be between about 19 cm and about 23 cm, between about 21 cm and about 25 cm, between about 23 cm and about 27 cm, between about 25 cm and about 29 cm, or between about 27 cm and about 31 cm. A ratio of the second and/or third diameters 142, 144 to the first diameter 140 may be between about 1.05:1 and about 1.15:1, between about 1.1:1 and about 1.2:1, between about 1.15:1 and about 1.25:1, between about 1.2:1 and about 1.3:1, between about 1.25:1 and about 1.35:1, between about 1.3:1 and about 1.5:1, or more. As shown, the second and third diameters 142, 144 are the same; however, in another embodiment, they may be different.

The first and second underreamers 116, 128 may be operated independently or together. The order in which the first and second underreamers 116, 128 are actuated into the active state is merely illustrative. For example, in another embodiment, the second underreamer 128 may be actuated into the active state before the first underreamer 116, or the first and second underreamers 116, 128 may be actuated simultaneously. Moreover, the (axial) direction in which the downhole tool 100 moves when the first and second underreamers 116, 128 are in the active state is merely illustrative. For example, in another embodiment, the downhole tool 100 may move away from the surface (i.e., downward, as shown by arrow 148) to increase the diameter of the first portion 150 of the wellbore 102 when the first underreamer 116 is in the active state, and/or the downhole tool 100 may move toward the surface (i.e., upward, as shown by arrow 146) to increase the second portion 152 of the wellbore 102 when the second underreamer 128 is in the active state. Thus, as may be appreciated, there are many possible methods to expand the second portion 152 of the wellbore 102 by combining or modifying the direction of drilling with the controlling of one or both underreamers 116, 128.

After the second underreamer 128 has increased the diameter of the second portion 152 of the wellbore 102, the second underreamer 128 is actuated into the inactive state. To actuate the second underreamer 128 back to the inactive state, one or more signals are sent down the wellbore 102 from the surface and received by the sensor 310. The electronics unit 330 interprets the signals and causes the solenoid 410 and the shaft 412 to move back toward from the valve seat 420 such that the plunger 414 sealingly engages with valve seat 420, thereby preventing fluid flow through the valve seat 420 and the flow tube 470.

With the fluid flow to the channel 234 and the first chamber 236 cut off, the force exerted by the compressed spring 246 overcomes the force exerted by the (now decreasing) pressure in the first chamber 236. This causes the first piston 242 and the sleeve 240 to move toward the first end portion 202 of the body 200 such that the sleeve 240 blocks fluid flow through the ports 232 in the mandrel 230. With the fluid flow to the second chamber 250 cut off, the force exerted by the compressed spring 260 (see FIG. 8) overcomes the force exerted by the (now decreasing) pressure in the second chamber 250. This causes a compressed spring 260 and a stop ring 262 (see FIG. 8) to move the cutter blocks 220 axially toward the second end portion 204 of the body 200 and radially-inward, thereby transitioning the second underreamer 128 back into the inactive state.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the foregoing is directed to embodiments of the present invention, other and further embodiments of the invention may be devised without departing from the basic scope thereof.

What is claimed is:

1. An underreamer for increasing a diameter of a wellbore, comprising:

a body having an axial bore extending at least partially therethrough;

a mandrel disposed within the bore of the body and having a port formed radially therethrough;

a sleeve disposed radially-outward from the mandrel and configured to move axially with respect to the mandrel from a first position to a second position, the sleeve blocking fluid flow through the port in the mandrel when in the first position and the sleeve allowing fluid flow through the port in the mandrel when in the second position;

a flow tube coupled to the mandrel, the sleeve arranged and designed to move axially from the first position to the second position when fluid flows through the flow tube;

a piston disposed radially-outward from the mandrel and proximate to the sleeve, wherein a chamber is defined between the piston and the mandrel, and a channel is defined through the mandrel and provides a path of fluid communication between the flow tube and the chamber, wherein the piston includes a port formed radially therethrough, and wherein the port in the piston is aligned with the port in the mandrel when the sleeve is in the second position; and a cutter block movably coupled to the body, an outer surface of cutter block being aligned with, or positioned radially-inward from, an outer surface of the body when the sleeve is in the first position, and the outer surface of the cutter block being positioned radially-outward from the outer surface of the body when the sleeve is in the second position.

2. The underreamer of claim 1, wherein the piston moves the sleeve from the first position to the second position when the fluid flows from the flow tube, though the channel, and into the chamber.

3. The underreamer of claim 2, further comprising first and second seals disposed between the piston and the mandrel, wherein the chamber is disposed between the first and second seals.

4. The underreamer of claim 1, further comprising first and second seals disposed between the sleeve and the mandrel, wherein the port in the mandrel is disposed between the first and second seals when the sleeve is in the first position.

5. The underreamer of claim 1, wherein the port in the mandrel comprises a plurality of ports that are circumferentially-offset from one another.

6. The underreamer of claim 1, further comprising a spring disposed between the mandrel and the body, wherein the spring is compressed when the sleeve moves from the first position to the second position.

7. The underreamer of claim 1, wherein the cutter block is configured to expand the diameter of the wellbore from a first diameter when the sleeve is in the first position to a second diameter when the sleeve is in the second position, and wherein a ratio of the second diameter to the first diameter is between about 1.15:1 and about 1.30:1.

8. An underreamer for increasing a diameter of a wellbore, comprising:

a body having an axial bore extending at least partially therethrough;

a control unit disposed within the bore of the body, the control unit comprising:

a sensor configured to receive a signal transmitted through the wellbore;

a control electronic system capable of processing the signal transmitted through the wellbore and received by the sensor;

a valve seat; and a plunger operated by the control electronic system and configured to move axially with respect to the valve seat in response to the signal received by the sensor, the plunger blocking fluid flow through the valve seat when in a first position, and the plunger allowing fluid flow through the valve seat when in a second position;

a flow tube coupled to the valve seat and configured to have fluid flow therethrough when the plunger is in the second position;

a mandrel coupled to the flow tube, the mandrel having a first port disposed radially therethrough in fluid communication with the flow tube, the mandrel also having a second port formed radially therethrough;

a sleeve disposed radially-outward from the mandrel and configured to move axially with respect to the mandrel from a first position to a second position when the fluid flows through the flow tube and the first port, the sleeve blocking fluid flow through the second port in the mandrel when in the first position, and the sleeve allowing fluid flow through the second port in the mandrel when in the second position; and a cutter block movably coupled to the body, an outer surface of cutter block being aligned with, or positioned radially-inward from, an outer surface of the body when the sleeve is in the first position, and the outer surface of the cutter block being positioned radially-outward from the outer surface of the body when the sleeve is in the second position.

9. The underreamer of claim 8, further comprising a solenoid configured to move the plunger axially with respect to the valve seat in response to the signal received by the sensor.

10. The underreamer of claim 8, wherein fluid flows through the bore of the body to a drill bit coupled to the body regardless of the position of the sleeve.

11. The underreamer of claim 8, further comprising a filter disposed radially-outward from the flow tube, wherein the fluid flows through the filter and the valve seat when the plunger is in the second position.

12. The underreamer of claim 8, wherein the sensor is selected from the group consisting of a flow sensor, a pressure sensor, a vibration sensor, and a combination thereof.

13. A method for increasing a diameter of a wellbore, comprising:

running a downhole tool into a wellbore, the downhole tool including an underreamer having a body and a mandrel disposed within a bore of the body;

transmitting a signal through the wellbore to a sensor disposed within the bore of the body;

moving a plunger disposed within the bore of the body from a first position to a second position in response to the signal received by the sensor, the plunger blocking fluid flow through a valve seat when in the first position and the plunger allowing fluid flow through the valve seat when in the second position;

flowing fluid through the valve seat, through a flow tube fluidly coupled to the valve seat, and through a channel disposed in the mandrel fluidly coupled to the flow tube when the plunger is in the second position;

moving a sleeve disposed radially-outward from the mandrel from a first position to a second position in response to the fluid flowing through the channel disposed in the mandrel from the flow tube, the sleeve blocking a port formed radially through the mandrel when in the first position, and the sleeve allowing fluid flow through the port in the mandrel when in the second position;

flowing the fluid from the flow tube, through the channel disposed through the mandrel, and into a first chamber defined between the mandrel and a piston;

moving the piston in response to the fluid flowing into the first chamber, wherein the piston moves the sleeve from the first position to the second position; and aligning a port formed radially through the piston with the port in the mandrel when the sleeve is in the second position; and moving a cutter block coupled to the body radially-outward in response to the sleeve moving from the first position to the second position.

14. The method of claim 13, further comprising:

flowing the fluid through the port in the mandrel and the port in the piston and into a second chamber; and equalizing a pressure of the fluid in the first chamber and the fluid in the second chamber.

15. The method of claim 13, further comprising moving a solenoid coupled to the plunger in response to the signal received by the sensor, wherein the solenoid moves the plunger from the first position to the second position.

16. The method of claim 13, wherein the underreamer is configured to stabilize the downhole tool within the wellbore when the sleeve is in the first position, and wherein the underreamer is configured to increase the diameter of the wellbore when the sleeve is in the second position.

* * * * *